United States Patent [19]

Kirk

[11] Patent Number: 4,544,993

[45] Date of Patent: Oct. 1, 1985

[54] FLOOR ILLUMINATING BEDSIDE LIGHT UNIT

[76] Inventor: Johnie C. Kirk, 531 Ivanhoe, Ypsilanti, Mich. 48197

[21] Appl. No.: 690,080

[22] Filed: Jan. 9, 1985

[51] Int. Cl.[4] ..... F21S 5/00; F21L 1/00

[52] U.S. Cl. ..... 362/153; 362/367; 362/801; 362/802

[58] Field of Search ..... 362/153, 249, 362, 367, 362/801, 802, 146, 152; 200/86.5

[56] References Cited

U.S. PATENT DOCUMENTS

| | | | |
|---|---|---|---|
| 919,811 | 4/1909 | Beynon | 362/802 X |
| 934,122 | 9/1909 | Woodman | 362/146 X |
| 2,185,051 | 12/1939 | Daigle | 362/802 X |
| 4,303,969 | 12/1981 | Hamilton et al. | 362/249 X |
| 4,340,929 | 7/1982 | Konikoff et al. | 362/153 |

FOREIGN PATENT DOCUMENTS

| | | | |
|---|---|---|---|
| 12590 | 9/1916 | United Kingdom | 362/153 |

*Primary Examiner*—Tony M. Argenbright

*Attorney, Agent, or Firm*—Stephenson and Boller

[57] ABSTRACT

A floor illuminating bedside light unit consisting of a generally horizontal foot mat member, switch means operatively associated with the underside of the foot mat for actuation in response to foot pressure on the mat member, and floor illuminating light members connected to the switch means for "on/off" operation in response to actuation of the switch means. The unit is positioned next to the bed in a position in which the bed occupant will step on the foot mat member when entering and leaving the bed. As a result, the unit is operable to illuminate the floor of a darkened bedroom when the bed occupant steps on the mat when leaving the bed and will continue said illumination until the occupant steps on the mat when returning to the bed.

3 Claims, 4 Drawing Figures

FLOOR ILLUMINATING BEDSIDE LIGHT UNIT

BACKGROUND AND SUMMARY OF THE INVENTION

The problem of getting out of and returning to a bed in a darkened bedroom without accident or injury is a familiar problem. This invention provides a workable solution to the problem in the form of a floor illuminating light unit that is conveniently positioned alongside the bed so that the bed occupant automatically steps on the unit when leaving and entering the bed. A pressure responsive switch mechanism in the unit operates to turn on the floor illuminating lights when the mechanism is acutated by the bed occupant stepping on the unit when leaving the bed. The floor illuminating lights then remain in their "on" condition until the bed occupant returns to the bed, at which time the occupant automatically steps on the bedside unit when entering the bed. The foot pressure operates the switch mechanism to turn off the lights.

The result is automatic illumination of the bedroom floor area near the bed without any requirement for the occupant to search for a light switch or make any conscious effort to locate a switch in the dark that will turn on the lights. The lights are automatically turned on by the action of the bed occupant stepping downward toward the floor in the vicinity of the bed.

It is an object of this invention, therefore, to provide an improved floor illuminating bedside light unit which is automatically actuated by the bed occupant entering and leaving the bed.

Further objects, features, and advantages of the invention will become apparent from a consideration of the following description and the appended claims, when taken in connection with the accompanying drawing in which:

Figure 1:
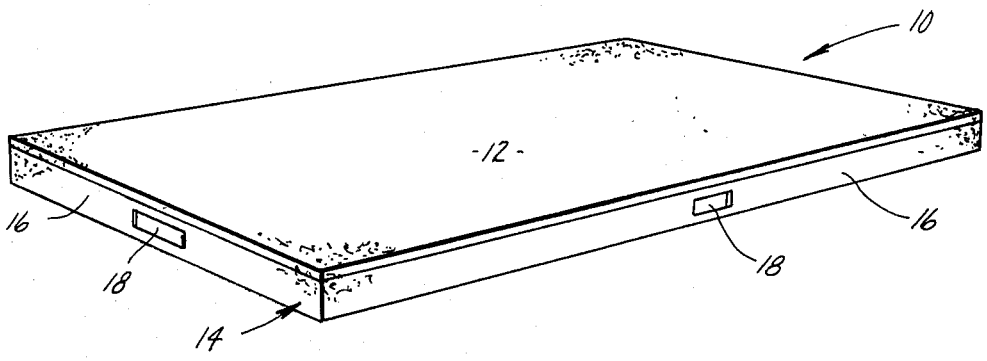
FIG. 1 is a perspective view of the light unit of this invention.
Figure 2:
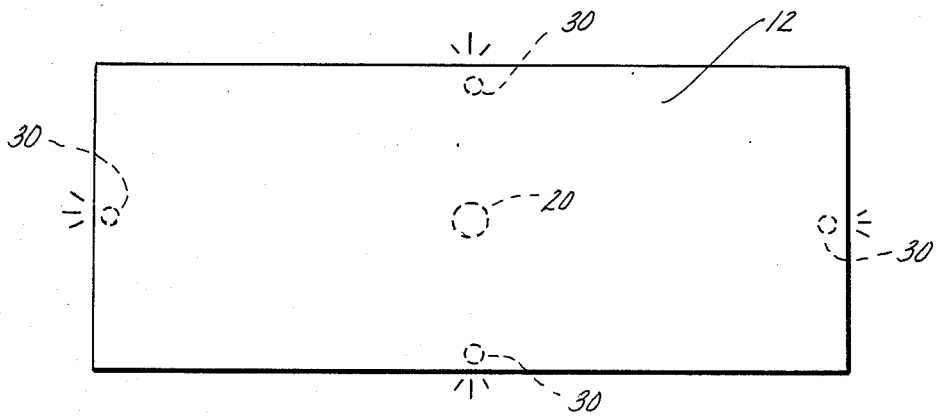
FIG. 2 is a top view of the unit.
Figure 3:
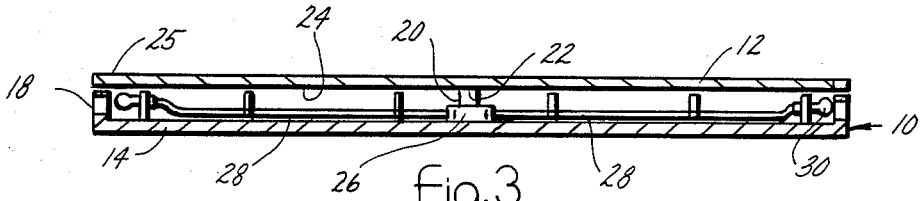
FIG. 3 is a longitudinal sectional view of the unit.
Figure 4:
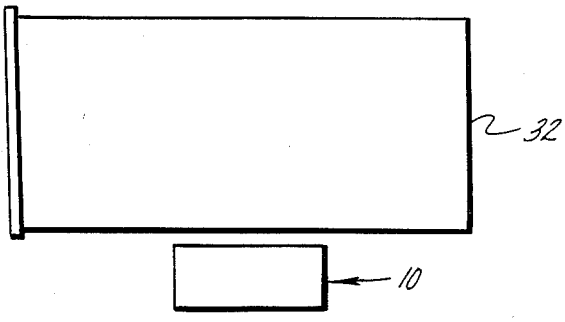
FIG. 4 is a diagrammatic view illustrating a bed and the unit of this invention in a position alongside the bed.

With reference to the drawing, the light and foot mat assembly of this invention, indicated generally at 10, is shown in FIG. 1 as including a top foot mat 12, illustrated as being of generally rectangular shape, and a main frame 14 on which the mat 12 is supported. As shown in FIGS. 1, 2, and 3, the main frame 14 has upright side and end walls 16 which are formed with windows 18 through which light can emerge from the assembly 10 to illuminate the floor area in the vicinity of the assembly 10.

As shown in FIG. 3, the assembly 10 also includes a switch unit 20 which is mounted so that its upper end 22 is in pressure engagement with the underside 24 of the floor mat 12. The mat 12 is of a rigid or semi-rigid construction so that in the event of foot pressure on any portion of the top surface 25 of the mat 12, the switch unit 22 will be actuated. The switch unit 22 is connected to a power source 26, such as alkaline batteries or the like, and the switch unit 22 and the batteries 26 are also connected by leads 28 to lights 30 aligned with the windows 18.

The switch unit 22 is a conventional unit of the type that on acutation provides for "on/off" operation of the lights 30.

In use, the assembly 10 is placed alongside a bed 32 at a position such that when the occupant of the bed gets out of the bed, the occupant will naturally and automatically step on the top surface 25 of the mat 12. The pressure of the occupant on the mat 12 will actuate the switch unit 22 so as to turn on all of the lights 30. Since the lights are located in a plurality of sides of the frame 14, they will illuminate a large area of the floor adjacent the bed 32. As a result, when the bed occupant proceeds to walk away from the bed 32, the occupant's path is well lighted by the assembly 10.

When the occupant desires to return to a sleeping position in the bed 32, the occupant steps on the mat 12 in order to return to the bed 32 and this pressure of the occupant's foot on the mat 12 creates the necessary force on the switch unit 22 to acutate the switch unit 22 and turn off the lights 30. The assembly 10 is then in condition for actuation so as to repeat the above cycle to again provide for illumination of the area adjacent the bed 32 at a time when such illumination is necessary for the safety and well being of the bed occupant.

From the above description it is seen that this invention provides a real solution to a problem of long standing, namely, the problem of getting up and moving away from the bed in which one has been sleeping without getting hurt. The assembly 10 is easily operated and is effective in illuminating the floor area near the bed. Further, by virtue of the battery power source 26, the unit 10 can readily be moved from its illustrated position alongside bed 32 to a position alongside another bed (not shown) when desired.

What is claimed:

1. In a bedroom environment which includes a bed in which an occupant normally sleeps and from which the occupant normally leaves and to which the occupant normally returns when the bedroom is dark, a floor illuminating light and foot mat assembly positioned on the bedroom floor at a position alongside the bed in which the occupant when normally leaving and returning to the bed will step on the assembly, said assembly comprising a generally horizontal foot mat member, switch means operatively associated with the underside of said foot mat member for actuation in response to foot pressure on said mat member, and floor illuminating light members operatively associated with said switch means for "on/off" operation in response to actuation of said switch means whereby said assembly is operable to illuminate the floor of said dark bedroom when the bed occupant steps on the mat when leaving the bed and continue said illumination until the occupant steps on the mat when returning to the bed.

2. The assembly according to claim 1 further including a main frame supporting said light members and said switch means, said mat member being mounted above said main frame and in pressure engagement with said switch means.

3. The assembly according to claim 2 wherein said main frame includes a plurality of side and end walls, and wherein said floor illuminating light members comprise a plurality of said light members located so as to project light through a plurality of said side and end walls.

* * * * *